US011127512B2

(12) United States Patent
Sangar et al.

(10) Patent No.: US 11,127,512 B2
(45) Date of Patent: Sep. 21, 2021

(54) CABLE FOR DOWNHOLE TRACTOR DEPLOYMENT

(71) Applicant: NEXANS, Paris (FR)

(72) Inventors: Robin K. Sangar, Drobak (NO); Arne Martin Aanerud, Oslo (NO)

(73) Assignee: NEXANS, Courbevoie (FR)

( * ) Notice: Subject to any disclaimer, the term of this patent is extended or adjusted under 35 U.S.C. 154(b) by 887 days.

(21) Appl. No.: 15/009,898

(22) Filed: Jan. 29, 2016

(65) Prior Publication Data

US 2016/0233008 A1 Aug. 11, 2016

(30) Foreign Application Priority Data

Feb. 10, 2015 (EP) ..... 15305193

(51) Int. Cl.
*H01B 7/18* (2006.01)
*E21B 17/00* (2006.01)
(Continued)

(52) U.S. Cl.
CPC ..... *H01B 7/1875* (2013.01); *E21B 17/003* (2013.01); *H01B 7/046* (2013.01); *H01B 9/04* (2013.01)

(58) Field of Classification Search
CPC ..... H01B 7/1875; H01B 7/046; H01B 9/04; E21B 17/003
(Continued)

(56) References Cited

U.S. PATENT DOCUMENTS 5,787,217 A * 7/1998 Traut ..... G02B 6/4411 385/100
9,627,100 B2 * 4/2017 Pourladian ..... H01B 13/0006
(Continued)

FOREIGN PATENT DOCUMENTS

WO 2014062061 4/2014

OTHER PUBLICATIONS

Search Report dated 2015.

*Primary Examiner* — Matthew R Buck
*Assistant Examiner* — Patrick F Lambe
(74) *Attorney, Agent, or Firm* — Sofer & Haroun, LLP

(57) ABSTRACT

The invention concerns a power cable suitable for providing power to and from a downhole tool situated within a borehole. The cable comprises at least one inner conductor comprising at least one first electrically conductive material, at least one inner insulating layer surrounding the inner conductor(s), comprising at least one electrically insulating material, an armour sheath surrounding the inner insulating layer(s) comprising at least one second electrically conductive material and at least one outer conducting layer surrounding, and electrically contacting, the armour sheath, comprising at least one third electrically conductive material. The armour sheath further comprises at least one inner radial layer comprising a plurality of armouring wires with a diameter D and at least one outer radial layer electrically contacting the inner radial layer(s), the outer radial layer(s) comprising a plurality of armouring wires (6*c*) with a diameter d the diameter d being dissimilar to the diameter D, and wherein said armouring wires are radially arranged, in a closed packed structure in order to maximize the armour sheath density.

14 Claims, 1 Drawing Sheet

(51) Int. Cl.
*H01B 7/04* (2006.01)
*H01B 9/04* (2006.01)

(58) Field of Classification Search
USPC ..... 166/65.1
See application file for complete search history.

(56) References Cited

U.S. PATENT DOCUMENTS

2012/0222869 A1 9/2012 Varkey
2015/0348677 A1* 12/2015 Pourladian ..... H01B 7/221
174/107

* cited by examiner

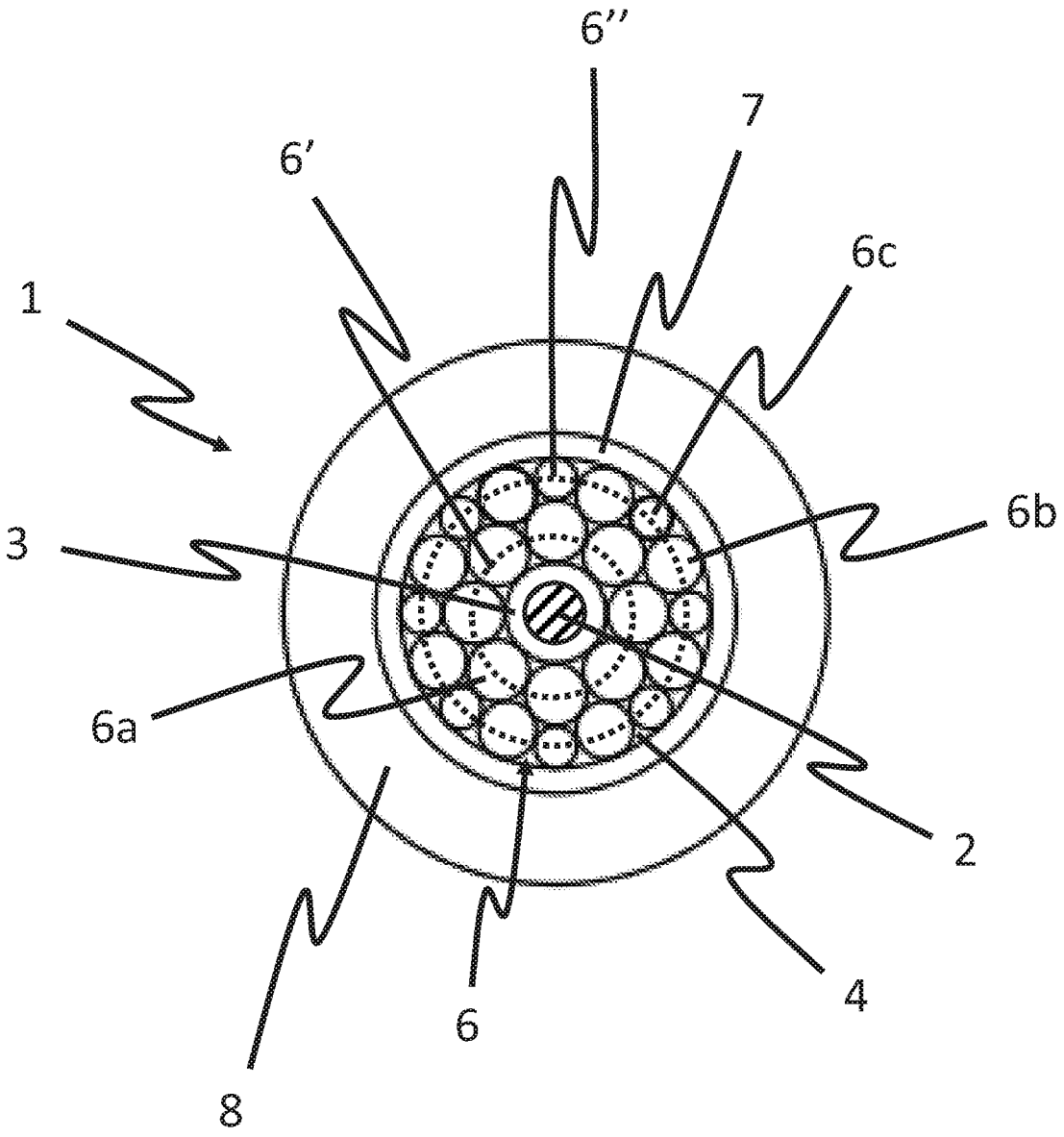
6''
7
6'
6c
1
6b
3
6a
2
4
6
8

CABLE FOR DOWNHOLE TRACTOR DEPLOYMENT

RELATED APPLICATION

This application claims the benefit of priority from European Patent Application No. 15 305 193.3, filed on Feb. 10, 2015, the entirety of which is incorporated by reference.

TECHNICAL FIELD

The present invention relates to a rigid cable for downhole tractor deployment as defined in the preamble of claim 1 and a well system using such a power cable.

BACKGROUND AND PRIOR ART

Vertical, inclined and horizontal drilling of boreholes plays an important role in the field of hydrocarbon production. Inclined and horizontal drilling is typically performed in order to recover oil from a plurality of nearby reservoirs, thereby avoiding the need of drilling a large number of vertical boreholes from the surface. In particular, it is often desirable to initially drill vertically downward to a predetermined depth, and then to drill at an inclined angle therefrom to reach a desired target location. This allows oil to be recovered from a plurality of nearby underground locations while minimizing drilling. In addition to oil recovery, boreholes with a horizontal component may also be used for a variety of other purposes such as coal exploration and the construction of pipelines and communication lines.

Two methods of drilling vertical, inclined and horizontal boreholes are rotary drilling and coiled tubing drilling.

In rotary drilling, a rigid drill string consisting of a series of connected segments of drill pipes is lowered from the around surface using surface equipment such as a derrick and draw works. Attached to the lower end of the drill string is a bottom hole assembly which may comprise a drill bit, drill collars, stabilizers, sensors and a steering device. A top drive system rotates the drill string, the bottom hole assembly and the drill bit, allowing the rotating drill bit to penetrate into the formation. The inclination of the rotary drilled borehole may be gradually altered by using known equipment such as a downhole motor with an adjustable bent housing to create inclined and horizontal boreholes.

In coiled tubing drilling, the drill string is a non-rigid, generally compliant tube. The tubing is fed into the borehole by an injector assembly at the ground surface. The coiled tubing drill string can have specially designed drill collars located proximate the drill bit that apply weight to the drill bit to penetrate the formation. The drill string is not rotated. Instead, a downhole motor provides rotation to the bit. Because the coiled tubing is not rotated, or not normally used to force the drill bit into the formation, the strength and stiffness of the coiled tubing is typically much less than that of the drill pipe used in comparable rotary drilling. Thus, the thickness of the coiled tubing is generally less than the drill pipe thickness used in rotary drilling, and the coiled tubing generally cannot withstand the same rotational, compression and tension forces compared to the drill pipe used in rotary drilling.

In both rotary and coiled tubing drilling, downhole tractors are used to apply axial loads to the drill bit, bottom hole assembly and drill string, and generally to move the entire drilling apparatus into and out of the borehole. The tractor may be designed to be secured at the lower end of the drill string. The tractor may have anchors or grippers adapted to grip the borehole wall just proximal the drill bit. When the anchors are gripping the borehole, hydraulic power from the drilling fluid may be used to axially force the drill bit into the formation. The anchors may advantageously be slidably engaged with the tractor body so that the drill bit, body and drill string can move axially into the formation while the anchors are gripping the borehole wall.

There exist numerous ways to achieve the above mentioned axial movement of the downhole tractors into the formation, Examples of different propulsion solutions may be found in patent publication U.S. Pat. No. 6,003,606 and CA 2'686'627 A1. However, a common need for all prior art solutions is the presence of adapted wireline cables extending from the ground surface sea level to the downhole tractors. The application of such cables may be challenging. One problem associated with the above mentioned tractoring operations is abrasion and/or cutting of the cables from the borehole casings, thereby causing cable damage and/or blockage. These problems increase with the length and/or degree of deviation of the borehole. Furthermore, the latter contributes to an increase friction between the outside surface of the cable and the borehole walls. In order to overcome the above mentioned problems it is common to surround the conducting core of the cable with a thick metallic armour sheath, which typically constitutes a coverage of 98% of the cable cross section. Examples of cables with such a metallic armour sheath may be found disclosed in patent publication WO 2011/037974, WO 03/091782 A1 and WO 97/30369 A1.

However, an additional problem with high weights and significant frictions during movements in inclined and/or horizontal boreholes is the need of increased motive power to the downhole tractors/tools. And an increase in power through the cable may require an increase in the conducting cross section of the cable, which again results in an increase in weight and/or friction.

There exist solutions were the cable itself is used to push the downhole tool along the borehole. This solution requires a cable having a high level of rigidity in order to enable the necessary pushing power to the downhole tool without risking significant cable buckling. The necessary rigidity has been achieved by covering the core copper conductors with a pure graphite sheath. However, this prior art solution has proved to be expensive and difficult to manufacture.

It is thus an object of the present invention to provide a power cable that both provides power to, and facilitates the movements of, downhole tractors/tools situated within boreholes. Another object of the present invention is to provide power cables that is easy to manufacture and which may accommodate larger power transmission compared to prior art solutions

SUMMARY OF THE INVENTION

The present invention is set forth and characterized in the main claim, while the dependent claims describe other characteristics of the invention.

In particular, the invention concerns a power cable suitable for providing power to and from a downhole tool situated within a borehole. The cable comprises at least one inner conductor comprising at least one first electrically conductive material, at least one inner insulating layer surrounding the inner conductor(s), comprising at least one electrically insulating material, an unmoor sheath surrounding the inner insulating layer(s) comprising at least one second electrically conductive material and at least one outer conducting layer surrounding, and electrically contacting, the armour sheath, comprising at least one third electrically conductive material. The armour sheath further comprises at least one inner radial layer comprising a plurality of armouring wires with a diameter D and at least one outer radial layer electrically contacting the inner radial layer(s), the outer radial layer(s) comprising a plurality of armouring wires (6*c*) with a diameter d, the diameter d being dissimilar to the diameter D, and wherein said armouring wires are radially arranged, in a closed packed structure in order to maximize the armour sheath density.

Hereinafter dissimilar diameters signifies mutual differences in wire diameters of more than 10%, more preferably more than 20%, for example 30%. Furthermore, conductive material signifies any material or combination of materials (e.g. mixture/alloys) that exhibits conductivity per unit length ($\sigma$) of more than $1\times10^4$ S/m at 20° C. (293 K) along at least part of the power cable, preferably along the whole length of the power cable. The conductivity per unit length of the first and third conductivity materials is preferably more than $1\times10^6$ S/m at 20° C., for example more than $1\times10^7$ S/m, at 20° C.

In one aspect of the power cable the inner conductor is a solid conductor. In this aspect the solid conductor avoids the risk of gas migration along the multiple wires of a stranded conductor.

In an advantageous embodiment the diameter D is larger than the diameter d.

In another advantageous embodiment the outer radial layer further comprises a plurality of armouring wires with diameter D' arranged at least partly between the armouring wires with the diameter d and at least partly between the armouring wires with the diameter D of the inner radial layer, wherein the diameter D' is larger than the diameter d, for example equal to diameter D.

In another advantageous embodiment the radially outermost surface positions of the armouring wires defining the outer radial periphery of the armour sheath constitute positions on a circle.

In another advantageous embodiment the second electrically conductive material(s) has/have higher tensile strength than at least one of the first and third electrically conductive material(s).

In another advantageous embodiment at least one of the first electrically conductive material(s) is identical to at least one of the third electrically conductive material(s).

In another advantageous embodiment at least one of the first and third conductive material(s) comprises mainly copper or a copper alloy.

In another advantageous embodiment the conductivity per unit length at 20° C. of the first and third electrically conductive material(s) is higher than the conductivity per unit length at 20° C. of the second electrically conductive material(s).

In another advantageous embodiment the second electrically conductive material(s) comprises mainly steel.

In another advantageous embodiment at least the majority of interstices within the armour sheath are filled with a pressure compensating filling material comprising an elastic material, for example a petroleum jelly.

In another advantageous embodiment at least one outer insulating layer surrounds the outer conducting layer(s), wherein the outer insulating layer(s) is/are preferably made of a fluorine based polymer such as a fluorine based polymer within the group poly/ethane-co-tetrafluoroethene (ETFE), fluorinated ethylene propylene (FEP), perfluoroethers (PFA), ethylene-fluorinated ethylene propylene (EFEP), or a combination thereof.

The invention also concerns a downhole tool assembly for drilling a borehole for hydrocarbon production, comprising at least one downhole tool and at least one power cable in accordance with any of the above mentioned embodiments which is/are in one longitudinal end electrically connected to the downhole tool.

In the following description, specific details are introduced to provide a thorough understanding of an embodiment of the claimed power cable. One skilled in the relevant art, however, will recognize that this embodiment can be practiced without one or more of the specific details, or with other components, systems, etc. In other instances, well-known structures or operations are not shown, or are not described in detail, to avoid obscuring aspects of the disclosed embodiments.

BRIEF DESCRIPTION OF THE DRAWING

FIG. 1 is a cross-sectional view of a power cable in accordance with an embodiment of the invention.

DETAILED DESCRIPTION OF THE INVENTION

A cross section of a power cable 1 in accordance with the invention is shown in FIG. 1. In this particular embodiment the power cable 1 comprises an inner core 2,3 composed of one or more insulated conductors 2, preferably of solid copper, surrounded by one or more electrically insulating sheaths 3. The inner core is surrounded by an armour sheath 6 comprising a plurality of stranded steel wires 6*a*,6*b*,6*c*. The interstices 4 formed between the steel wires 6*a*,6*b*,6*c* are preferably filled with a pressure compensating filling compound such as a petroleum jelly that may block undesired gas migration and/or ensure sufficient pressure compensation during operation. Particularly the latter effect may reduce the risk of crack formation. The armour sheath 6 is further surrounded by a conducting tube 7, preferably of copper, that may be act as a main return conductor for power transmission from the downhole tool/tractor. The tube 7 is surrounded by an outer insulating layer 8 made of an electrically insulating material, thereby acting as an outermost sheath for the power cable 1. The layer 8 may for example be made of a fluropolymer such as ETFE (ethylene tetrafluoroethylene).

The above described configuration provides a power cable 2 having a main return conductor 7 compactly arranged within the cable's 1 cross section. This relatively simple cable design makes the production of power cables of long length (i.e. several kilometres) easier while allowing accommodation of a larger power transmission compared to prior art solutions.

The main purpose of the armour sheath 6 is to protect the inner insulated conductor(s) 2 and give the cable 1 high longitudinal strength, i.e. at strength that at least corresponds to a strength necessary for the cable 1 to carry its own weight. This is often a critical requirement for cables employed at large sea depths such as depths of more than four kilometres. For this reason the armour sheath 6 preferably exhibits higher tensile strength than both the inner core 2,3 and the tube 7. Relevant examples of conductive materials with high tensile strength may be various steel types, tungsten, titanium alloys and aluminium alloys, or a combination thereof. In the embodiment of FIG. 1 this armour sheath 6 comprises radial layers 6',6" made of a plurality of steel armouring wires 6*a*,6*b*,6*c* which are mutually arranged to reach highest possible, or close to highest possible, density. One way to achieve such an maximum packing density is to stack the wires 6*a*,6*b*,6*c* radially in a closed packed structure (cps), or near closed packed structure, where at least some of the wire diameters D, D', d are dissimilar. FIG. 1 shows an inner radial layer 6' of armouring wires with a wire diameter D 6*a* arranged in contact with the insulating sheath 3, and an outer radial layer 6" of armouring wires 6*b*,6*c* surrounding the inner radial layer 6', wherein wires of a small wire diameter d 6*c* alternates with wires of a larger diameter D' 6*b*, for example equal to the wire diameter a Further, the wires 6*b*,6*c* of the second layer 6" are arranged within the outer valleys or recesses set up by the wires 6*a* of the inner radial layer 6'. With this particular configuration of the armour sheath 6 the outermost radial position of each armouring wires 6*b*,6*c* constituting the outer radial layer 6" in FIG. 1 represents points on a perfect, or near perfect, circle having the inner core 2,3 as a centre.

The armour sheath 6 and the tube 7 are preferably electrically connected along at least the major part of the cable's longitudinal length in order to maximise the radial cross section in which electrical power may flow during return from the downhole tool.

Note that the direction of the power flow may be interchanged as convenient. For example, in an alternative embodiment of the invention armour sheath 6 and/or the tube 7 may act as an conductor for the power flow into the downhole tool, in which case the one or more insulated conductors 2 of the inner core 2,3 act as the conductor for the power flow from the downhole tool, Typical dimensions of the inventive power cable 1 are

- a solid conductor 2 having diameters within the range of 2-3 mm, for example 2.45 mm.
- armouring wires 6*a* of the inner layer 6' having diameters (D) within the range of 1-2 mm, for example 1.52 mm,
- armouring wires 6*b* of the outer layer 6" having large (D') and small (d) diameters within the range of 1.3-1.6 mm, for example 1.52 mm, and within the range of 0.96-1.16 mm, for example 1.06 mm, respectively
- a conductive tube 7 of diameter within the range of 7-10 mm, for example 8.65 mm and
- an outer insulating layer 8 of diameter within the range 10-20 mm, for example 15 mm.

The above mentioned radial arrangement is typically arranged in order to support a cable weight of at least 4 km sea depth, for example 5 km sea depth. The weight of the inventive power cable 1 may be within the range 0.4-0.8 kg/m, for example about 0.6 kg/m.

The power cable 1 may be used as part of a downhole tool arrangement such as a cable transmitting necessary power to a downhole tractor within a hydrocarbon producing well.

LIST OF REFERENCE NUMERALS

Power cable 1
Insulated conductor 2
Electrically insulating sheath 3
Interstices (between armour wires) 4
Armour sheath 6
Armouring wire with diameter D 6*a*
Armouring wire with diameter D' 6*b*
Armouring wire with diameter d' 6*c*
Inner radial layer 6'
Outer radial layer 6"
Conducting tube 7
Outer insulating layer 8

The invention claimed is:

1. A power cable for providing power to a downhole tool situated within a borehole, comprising:

an inner conductor comprising a first electrically conductive material, an inner insulating layer surrounding the inner conductor, comprising an electrically insulating material, an armour sheath surrounding the inner insulating layer comprising a second electrically conductive material and an outer conducting layer surrounding, and electrically contacting, the armour sheath, comprising a third electrically conductive material, wherein the armour sheath further comprises an inner radial layer comprising a plurality of armouring wires with a diameter D and an outer radial layer electrically contacting the inner radial layer, the outer radial layer comprising a plurality of armouring wires with a diameter d, the diameter d being dissimilar to the diameter D, and wherein said armouring wires are radially arranged in order to maximize the armour sheath density, wherein the diameter D is larger than the diameter d.

2. The power cable in accordance with claim 1, wherein the inner conductor is a solid conductor.

3. The power cable in accordance with claim 1, wherein the outer radial layer further comprises a plurality of armouring wires with diameter D' arranged at least partly between the armouring wires with the diameter d and at least partly between the armouring wires with the diameter D of the inner radial layer, wherein the diameter D' is larger than the diameter d.

4. The power cable in accordance with claim 1, wherein, in the radial direction, the outermost surface positions of the armouring wires defining the outer periphery of the armour sheath constitute positions on a circle.

5. The power cable in accordance with claim 1, wherein the second electrically conductive material has higher tensile strength than at least one of the first and third electrically conductive material.

6. The power cable in accordance with claim 1, wherein at least one of the first electrically conductive material is identical to at least one of the third electrically conductive material.

7. The power cable in accordance with claim 1, wherein at least one of the first and third conductive material comprises mainly copper.

8. The power cable in accordance with claim 1, wherein the conductivity per unit length at 20° C. of the first and third electrically conductive material is higher than the conductivity per unit length at 20° C. of the second electrically conductive material.

9. The power cable in accordance with claim 1, wherein the second electrically conductive material comprises mainly steel.

10. The power cable in accordance with claim 1, wherein at least the majority of interstices within the armour sheath are filled with a pressure compensating filling material of petroleum jelly comprising an elastic material, and wherein an outer insulating layer, separate from said pressure compensating material surrounds the outer conducting layer.

11. The power cable in accordance with claim 1, wherein the outer insulating layer comprises mainly a fluorine based polymer.

12. The power cable in accordance with claim 1, wherein the outer insulating layer comprises mainly a fluorine based polymer within the group poly/ethane-co-tetrafluoroethene (ETFE), fluorinated ethylene propylene (FEP), perfluoroethers (PFA), ethylene-fluorinated ethylene propylene (EFEP).

13. The power cable in accordance with claim 11, wherein the outer insulating layer comprises mainly a fluorine based polymer within the group poly/ethane-co-tetrafluoroethene (ETFE), fluorinated ethylene propylene (FEP), perfluoroethers (PFA), ethylene-fluorinated ethylene propylene (EFEP).

14. A downhole tool assembly for drilling a borehole for hydrocarbon production, comprising a downhole tool and a power cable constructed in accordance with claim 1, being in one longitudinal end electrically connected to the downhole tool.

* * * * *